United States Patent [19]

Constance-Hughes

[11] Patent Number: 4,960,120

[45] Date of Patent: Oct. 2, 1990

[54] BREATHING APPARATUS

[75] Inventor: Trevor Constance-Hughes, Abergavenny, United Kingdom

[73] Assignee: Siebe Gorman & Company Limited, Windsor, England

[21] Appl. No.: 263,772

[22] PCT Filed: Feb. 16, 1988

[86] PCT No.: PCT/GB88/00097

§ 371 Date: Nov. 10, 1988

§ 102(e) Date: Nov. 10, 1988

[87] PCT Pub. No.: WO88/06047

PCT Pub. Date: Aug. 25, 1988

[30] Foreign Application Priority Data

Feb. 16, 1987 [GB] United Kingdom ..... 8703523

[51] Int. Cl.[5] ..... A62B 7/02; A62B 7/10; A62B 9/02

[52] U.S. Cl. ..... 128/205.22; 128/205.24; 128/205.12

[58] Field of Search ..... 128/204.26, 205.22, 128/204.18, 204.28, 205.12, 205.17, 205.24

[56] References Cited

U.S. PATENT DOCUMENTS

| | | | |
|---|---|---|---|
| 2,418,034 | 3/1947 | Kizaur | 128/204.26 |
| 2,456,130 | 12/1948 | Lambertsen | 128/205.27 |
| 2,552,595 | 5/1951 | Seeler | 128/204.26 |
| 2,764,151 | 9/1956 | Cupp | 128/204.26 |
| 4,031,887 | 6/1977 | Botos et al. | 128/205.12 |
| 4,060,076 | 11/1977 | Botos et al. | 128/204.29 |
| 4,163,448 | 8/1979 | Grouard | 128/204.26 |
| 4,186,735 | 2/1980 | Henneman et al. | 128/204.26 |
| 4,269,216 | 5/1981 | Sullivan et al. | 128/204.26 |
| 4,811,732 | 3/1989 | Harting | 128/204.26 |

FOREIGN PATENT DOCUMENTS

| | | |
|---|---|---|
| 285439 | 7/1928 | United Kingdom . |
| 1358303 | 7/1974 | United Kingdom . |
| 2015348 | 9/1979 | United Kingdom . |
| 2041762 | 9/1980 | United Kingdom . |

*Primary Examiner*—Edgar S. Burr
*Assistant Examiner*—Kimberly L. Asher
*Attorney, Agent, or Firm*—Merchant, Gould, Smith, Edell, Welter & Schmidt

[57] ABSTRACT

A closed circuit breathing apparatus with a simplified start-up procedure. The demand valve diaphragm (38) has in it a one way valve (51 and 52) that allows exhaled breath to escape from the apparatus. Movement of the diaphragm reciprocates a latch (63) through a series of stops (65 to 68). When the user inhales for the second time, the latch (63) escapes from the last stop (68), a spring (69) is released, the one-way valve is clamped shut by a plate (55), and a probe (73) releases a catch (35) and allows a breathing bag (13) to open.

20 Claims, 3 Drawing Sheets

BREATHING APPARATUS

The invention relates to breathing apparatus, and especially to self-rescue breathing apparatus, that is to say, to a small, compact breathing apparatus that can be carried by, for example, a miner, as part of his normal equipment and can be brought into use in an emergency to enable the wearer to escape from or through regions of suffocating or poisonous gas or water.

Because self-rescue breathing apparatus is worn by ordinary workers, who may not be highly trained and who will seldom actually use the apparatus, and because when the apparatus is used it may have to be brought into use quickly and reliably under emergency conditions, it is desirable that the procedure for starting to use the apparatus should be as simple as possible.

In the past, however, forms of self-rescue breathing apparatus have been proposed that require a variety of procedures for starting to use them, some being quite elaborate.

It is an object of the invention to provide a breathing apparatus that a user can start to use as simply as possible, and that is tolerant of being subjected to more elaborate start up procedures such as have previously been proposed.

The invention provides closed-circuit breathing apparatus arranged when brought into use to operate initially with an open circuit and then to change automatically to closed-circuit operation.

The subsequent operation of the apparatus depends to a large extent on the condition of the apparatus at the moment when it changes over from open-circuit to closed-circuit operation, which can be determined by the means that effects the changeover, and can thus be less subject than in previously proposed forms of apparatus to the initial actions of the user.

The apparatus may comprise means responsive to the breathing of a user to cause the change to closed-circuit operation. That can virtually ensure that the user has in fact started to use the apparatus properly, and is especially advantageous with apparatus in which oxygen is supplied from a reservoir under pressure higher than ambient pressure, because if one complete exhalation is allowed between the user's beginning to breathe with the apparatus and the apparatus's changing to closed-circuit operation a high proportion of the nitrogen in the user's lungs and in the apparatus will be expelled, which is in general advantageous with that sort of apparatus.

The apparatus may comprise a demand valve for supplying oxygen to a user and in operation a common pressure-responsive means then advantageously both operates the demand valve and causes the change to closed-circuit operation. The pressure-responsive means preferably comprises a diaphragm that in use is exposed on one face to ambient pressure and on the other to a gas pressure within the breathing apparatus.

The apparatus may comprise a member movably mounted and resiliently urged to move, a plurality of stops, and a latch reciprocable between positions in which it can so engage different ones of the said stops as to prevent movement of the movably mounted member, the arrangement being such that the breathing of a user can cause the latch to reciprocate and to engage and pass each said stop in turn, and that after the latch passes the last stop the movably mounted member is free to move to cause or permit the apparatus to change to closed circuit operation. The reciprocating latch then in effect counts a predetermined number of inhalations and exhalations before permitting the change to closed-circuit operation. The movably mounted member is advantageously rotatably mounted and then preferably bears the reciprocable latch on a radially outer portion of it, the stops then being on an adjacent fixed member of the apparatus.

The rotatably mounted member may be rotatable in a plane that lies parallel to a diaphragm that is arranged to cause reciprocation of the reciprocable latch, and the rotatably mounted member then preferably sweeps out as it rotates a region of that plane that lies substantially face-to-face with the diaphragm.

The apparatus may be arranged to change to closed-circuit operation when the user inhales from it for the second time.

The apparatus may comprise a non-return valve for permitting gas exhaled by the user to escape from the apparatus in open-circuit operation and means for holding the non-return valve closed in closed-circuit operation. The apparatus advantageously comprises a diaphragm having at least one aperture therethrough and a flap attached to the diaphragm and overlying the aperture or apertures, constituting the said non-return valve, a closure member arranged to hold the flap against the diaphragm to hold the non-return valve closed in closed-circuit operation, and an actuator arranged to act between the diaphragm and the closure member to effect the closure of the non-return valve when the apparatus changes to closed-circuit operation.

The above-mentioned means responsive to the breathing of a user may comprise the said diaphragm having at least one aperture therethrough. If the apparatus also comprises a rotatably-mounted member as mentioned above, the actuator is advantageously rotatable with the rotatably mounted member and arranged to act by its rotation to urge the closure member against the flap when the rotatably-mounted member reaches a predetermined orientation. Preferably, in that case, the diaphragm and the closure member are non-rotatably mounted, the actuator is secured against axial movement relative to the diaphragm, and rotation of the actuator over a pre-determined part of its travel is arranged to cause axial movement of the closure member by the engagement of cam means.

The apparatus may comprise a breathing bag that in a ready-for-use condition of the apparatus is stored in a collapsed condition, and means for releasing the breathing bag when the apparatus changes to closed-circuit operation. By releasing the breathing bag only when the apparatus changes to closed-circuit operation, it is ensured that closed-circuit operation commences with the breathing bag in a known state, leading to more reliable operation, and the risk that the breathing bag might have filled with undesirable gases can also be avoided.

A housing portion of the apparatus may have a pair of detachable end-caps, within one of which is stored the breathing bag and within the other of which is stored a facemask, mouthpiece, or the like, and when the apparatus is brought into use both end-caps may be released from a common fastening, and the said one end-cap, over the breathing bag, is then advantageously held by a catch until the apparatus changes to closed-circuit operation.

The apparatus then preferably comprises a probe that is retained within the said one end-cap when that end-cap is closed but is free of the said one end-cap when that end-cap is held by the said catch, and which probe is arranged to release the catch when the apparatus changes to closed-circuit operation, and thereby to release the breathing bag. The retention of the probe within the said one end-cap may retain in an initial position a mechanism for effecting the change to closed circuit operation.

One form of compressed-oxygen self-rescue breathing apparatus constructed in accordance with the invention will now be described by way of example only with reference to the accompanying drawings, in which.

Figure 1:
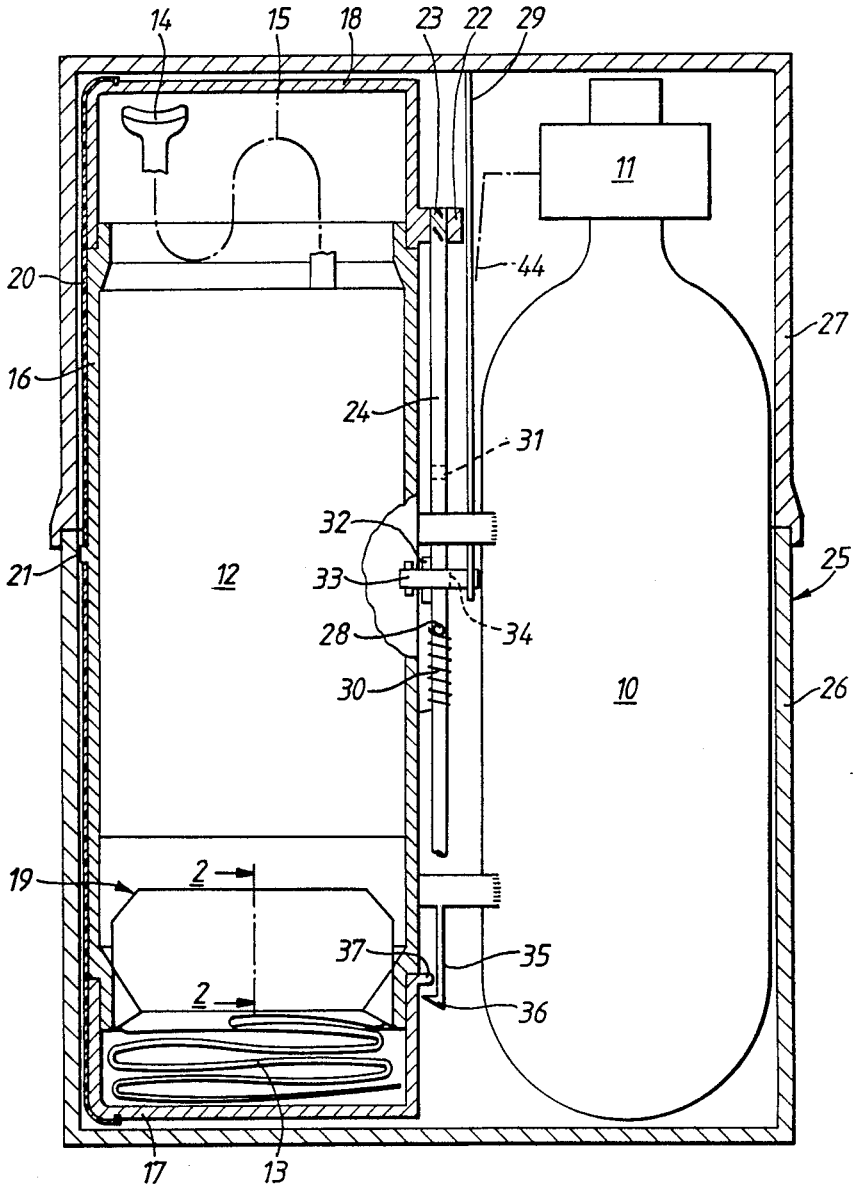
FIG. 1 is a schematic sectional front elevation view of the breathing apparatus in a ready-for-use condition.

Referring to the accompanying drawings, and initially to FIG. 1, one form of closed-circuit breathing apparatus comprises an oxygen cylinder 10 with a reducing valve 11, a purifier 12 that contains a chemical that absorbs carbon dioxide, a breathing bag 13, and a mouthpiece 14 in communication with the purifier by means of a flexible hose 15. All of those components may be substantially as described in our European Patent Application No. 0 194 145 or of other known forms, and in the interests of conciseness they are not described in detail herein.

As may be seen in FIG. 1, the apparatus comprises two generally cylindrical modules which, in a normal orientation of the apparatus, are upright and side by side. One module comprises the oxygen cylinder 10 and the reducing valve 11, the other module comprises a housing 16 containing the purifier 12 and, in the ready-for-use condition shown in FIG. 1, the breathing bag 13 stored within a bottom end-cap 17 and the mouthpiece 14 and hose 15 stored within a top end-cap 18.

A demand valve indicated generally by the reference numeral 19 is disposed in a lower portion of the housing 16, between the purifier 12 and the breathing bag 13. The breathing bag 13 is in communication with the purifier 12 by way of passages (not shown in detail) between the outside of the demand valve 19 and the inside of the housing 16.

The end-caps 17 and 18 are secured to the body of the second module by a plastics strap 20, end portions of which fit into slots in the end faces of the end caps and a central portion of which has an aperture that is clipped over a stud 21 on the housing 16. As seen in FIG. 1, the strap 20 is in tension both above and below the stud 21. On the side opposite the strap 20, the end caps 17 and 18 are provided with tubular lugs 22 within which are received end portions 23 of a vertical shaft 24 that is rotatably secured to the housing 16. In the interests of clarity, the lower lug 22 and the lower end of the shaft 24 have been broken away in FIG. 1. The upper end portion 23 has on it a steep double-start left-hand thread which is engaged when the top end-cap 18 is closed by a pair of pins (not shown) projecting from the inside of the upper lug 22. The lower end portion 23 has on it a right-hand thread similarly engaged. The threads are so arranged that a rotation of the shaft 24 of about 180° anticlockwise is required from a condition in which both end-caps 17 and 18 are held tightly closed by the shaft 24 to a point at which they are released from the end portions 23 of the shaft.

As shown in FIG. 1, the apparatus is stored in a case indicated generally by the reference numeral 25 and having a bottom part 26 and a top part 27. The apparatus is held into the bottom part 26 of the case 25 by a projection 28 on the shaft 24 engaging under a resilient member (not shown) attached to the bottom part of the case. A torsion spring 30 urges the shaft 24 to rotate in a sense to release the caps 17 and 18, but with the case 25 closed the shaft is held against the force of the spring by a metal rod 29 extending downwards from the top wall of the top part of the case, and holding down a spring-loaded lever 33 that is pivotally mounted on the housing 16, inside the bottom part 26 of the case 25, and under which is trapped a protrusion 32 on the shaft 24. The lever 33 has a step 34 on its inner surface and facing towards the protrusion 32. The protrusion 32 may be provided with a roller (not shown) at its distal end. The metal bar 29 is held behind a cross-brace connecting the two modules of the apparatus, which prevents the bar's being deflected out of position by the force exerted by the lever 33.

There is a hole 31 through the shaft 24, into which a tommy-bar may be inserted to enable the shaft to be rotated manually when the apparatus is being assembled into the condition shown in FIG. 1.

A resiliently flexible catch 35, with a hooked tip 36, extends downwards from a cross-brace that connects the housing 16 to the other module of the apparatus. The tip 36 of the catch 35 projects under a lip 37 on the bottom end-cap 17, with a space between them.

The two parts 26 and 27 of the case 25 are secured together by a tamper-proof fastening (not shown) which may be of conventional design.

Figure 2:
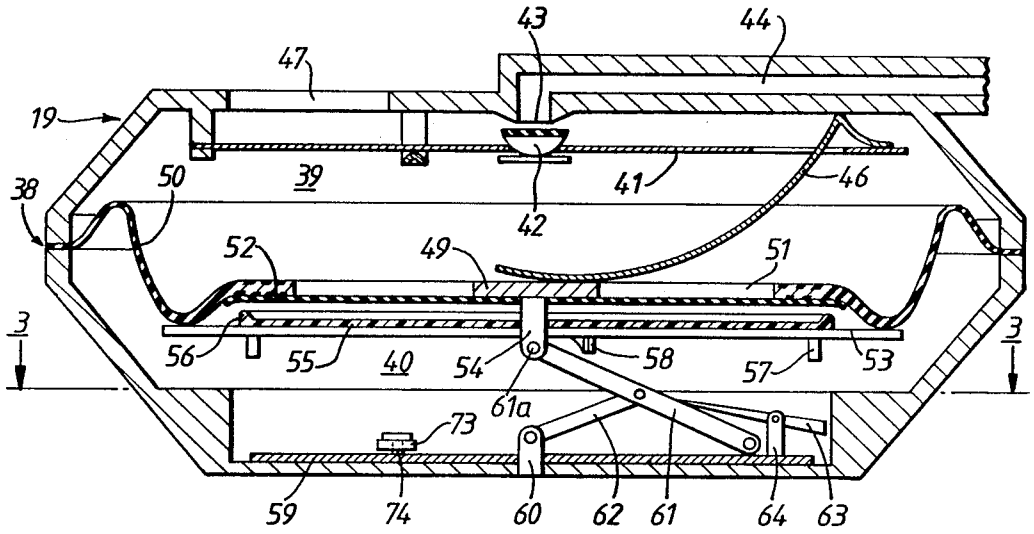
FIG. 2 is a fragmentary sectional view taken along the line 2—2 in FIG. 1.

Referring now to FIG. 2, the demand valve 19 comprises a diaphragm indicated generally by the reference numeral 38 dividing its interior into an upper chamber 39 and a lower chamber 40. The upper chamber 39 contains a valve lever 41 carrying a valve member 42 which is arranged to cover over an inlet 43 to which oxygen is supplied by a pipe 44 from the reducing valve 11. An actuating lever 46 transmits movement of the diaphragm 38 to the valve lever 41, and an opening 47 provides communication between the upper chamber 39 of the demand valve 19 and the breathing-gas circuit of the apparatus. The components in the upper chamber 39 may be substantially as disclosed in our above-mentioned European patent application No. 0 194 145. Instead, any suitable demand-valve mechanism may be used. The demand valve 41 to 43 is held shut against the pressure in the supply 44 except when it is opened by the action of a pressure difference across the diaphragm 38.

The diaphragm 38 comprises a rubber-coated brass dish 49, and a flexible rubber peripheral portion 50. The dish 49 has a flat central portion with a number of apertures 51 through it, and a flexible rubber flap 52, attached to the underside of the dish 49 at its centre, covers the apertures 51 and may extend slightly beyond the edge of the flat central portion of the dish.

A rigid beam 53 extends across a diameter of the dish 49. The beam is attached to a rim portion of the dish 49 at both ends, and is spaced below the flat central portion of the dish. A post 54 projects downwards from the dish through the beam 53. A rigid plastics plate 55 rests on the beam 53 and is centred by the post 54, which passes through a central aperture of the plate. The plate 55 has a peripheral bead 56 on its upper surface, which as seen in plan view lies inside the periphery of the flap 52 but outside the apertures 51. The plate 55 has on its underside projections 57 that extend downwards on either side of the beam 53 and abut the sides of the beam to prevent the plate from rotating about the post 54, and circumferentially extending cam ramps 58.

Figure 3:
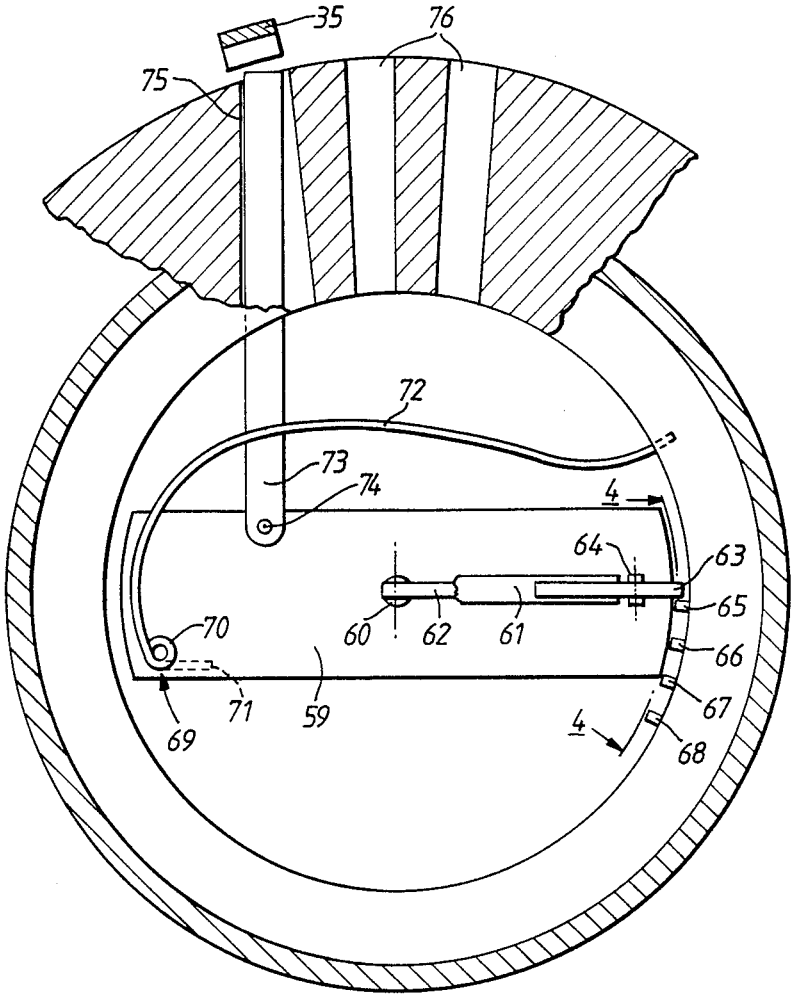
FIG. 3 is a sectional view taken along the line 3—3 in FIG. 2.
Figure 4:
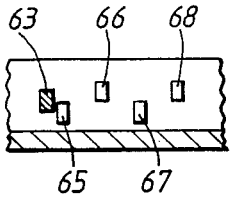
FIG. 4 is a fragmentary sectional view taken along the line 4—4 in FIG. 3.

Referring now also to FIG. 3, in the bottom of the lower chamber 40 of the demand valve 19 is a baseplate 59 that is rotatable about a central pivot 60, the pivot 60 being co-axial with the post 54 of the diaphragm 19. A lever 61 has one end so attached to the post 54 that it can both pivot in a vertical plane about its point of attachment and rotate, with the baseplate 59, about the axis of the post 54 and has its other end so attached to the baseplate that it can only slide radially over the surface of the baseplate. A crossbar 61*a* extends from the point of attachment of the lever 61 to the post 54, perpendicular to the lever. A second lever 62, half as long as the first lever 61, has one end pivotally attached to the pivot 60 and the other end pivotally attached to the midpoint of the first lever. A latch 63 is mounted on trunnions 64 near the periphery of the baseplate 59 so that its radially inner end rests on the first lever 61 under the action of a spring (not shown) and can be lifted by the first lever as the lever is lifted by the diaphragm. The latch 63 may prevent rotation of the baseplate 59 by abutting one of two lower stops 65 and 67 or one of two upper stops 66 and 68 (see FIG. 4).

A spring indicated generally by the reference numeral 69 comprises a coiled body portion 70, a first limb 71 received in a hole in the baseplate 59, and a long second limb 72, a distal end portion of which is received in a hole in a wall of the demand valve 19. As seen in FIG. 3, the spring 69 urges the baseplate 59 to rotate clockwise.

A probe 73 is attached to the baseplate 59 at a pivot 74, and extends through a slot 75 that passes through the wall of the demand valve and through the housing 16, emerging at a point that in the ready-for-use configuration of the apparatus is covered and sealed from the exterior by the bottom end-cap 17. The probe 73 and the pivot 74 are so positioned that the latch 63 is then just before the first lower stop 65, as shown in FIG. 3, and the distal end of the probe 73 is approximately flush with the outside of the housing 16 and is held in by the bottom end-cap 17, and that if (the end-cap 17 having been removed) the baseplate 59 were to rotate under the action of the spring 69, carrying the latch 63 past and beyond the stops 65 to 68, the probe 73 would extend out of the aperture 75 and engage the catch 35.

In the absence of the bottom end-cap 17, the slot 75 and other slots 76 provide communication between the external atmosphere and the lower chamber 40 of the demand valve 19.

The operation of the apparatus is as follows:

The apparatus is stored in the case 25 which is secured by suitable attachment means (not shown) to, for example, a belt round a user's waist, unless and until an appropriate emergency arises. The user then breaks the tamper-proof fastening and separates the two parts 26 and 27 of the case 25. Because the projection 28 is engaged with the bottom part 26 of the case 25, the apparatus remains in that part and the top part 27 is removed from the apparatus. The metal rod 29 is thus withdrawn, releasing the lever 33 and permitting the shaft 24 to turn under the action of the spring 30.

The shaft 24 rotates until the projection 32 on the shaft meets and catches on the step 34 on the lever 33. The lever 33 cannot lift far enough for the projection 32 to pass under the step 34, because the lever abuts the inside of the bottom part 26 of the case 25. The shaft 24 has then turned through about 90°, and the projection 28 has been swung far enough to free it from the bottom part 26 of the case 25. The rotation of the end portions 23 of the shaft 24, and the engagement between the screw-threads on those end portions and the pins on the lugs 22, assisted by the tension in the plastics strap 20, has lifted both end-caps 17 and 18 far enough from their seatings to break the seals between the end-caps and the housing 16, enabling the pressure inside the apparatus and in both chambers of the demand valve 19 to become equal to local ambient pressure. The end-caps 17 and 18 are not free from the shaft 24, however, and the bottom end cap 17 has not yet moved far enough to release the probe 73.

The apparatus is then removed from the bottom part 26 of the case 25, releasing the lever 33, allowing the protrusion 32 to pass under the step 34, and thus allowing the shaft 24 to rotate until the lugs 22 are release from the end portions 23 of the shaft 24. The top end-cap 18 then comes off the housing 16 entirely, under the action of the plastics strap 20, exposing the mouthpiece 14 and its connecting hose 15.

The bottom end-cap 17 opens only partly, because the lip 37 on the end-cap engages the hooked tip 36 of the flexible catch 35. The end-cap 17 does, however, move far enough to uncover the slots 75 and 76 and free the distal end of the probe 73.

If transient effects when the end-caps 17 and 18 are released cause the pressure in the upper chamber 39 of the demand valve 19 to be lower than that in the lower chamber 40, so that the diaphragm 38 rises and the outer end of the latch 63 is lowered, then the latch will be held by the first lower stop 65 when the probe 73 is released. The pressures will quickly equalise, however, (both becoming equal to the ambient pressure) and the demand valve will return to its resting position with the valve 42 and 43 closed, the diaphragm 38 down, and the outer end of the latch 63 up. The baseplate 59 will rotate slightly until the latch 63 engages the first upper stop 66. If the diaphragm is down when the probe 73 is released, then the latch 63 will move directly into engagement with the first upper stop 66.

The user then fits the mouthpiece 14 to his mouth, puts a clip (not shown) on his nose, and starts breathing using the apparatus. If the user starts by exhaling, the exhaled gas will enter the upper chamber 39 of the demand valve 38 through the opening 47, pass through the non-return valve 51 and 52 into the lower chamber 40 of the demand valve, and escape to the exterior through the slots 75 and 76.

The first time that the user inhales from the apparatus, the reduction in pressure in the upper chamber 39 will lift the diaphragm 38, because the flap 52 will act as a non-return valve preventing gas from flowing upwards through the apertures 51, and in the usual manner the movement of the diaphragm will open the valve 42 and 43 and supply oxygen to the user. The movement of the diaphragm 38 will also raise the first lever 61 and thus the inner end of the latch 63, lowering the outer end of the latch under the first upper stop 66. The baseplate 59 will then rotate until the latch 63 engages the second lower stop 67.

The user then exhales, the diaphragm 38 falls, and the outer end of the latch 63 lifts over the second lower stop 67 and engages the second upper stop 68. The exhaled gas escapes, as described above, through the apertures 51 in the diaphragm 38. That exhaled gas consists in a substantial part of oxygen previously inhaled, but it is believed that the disadvantage of any waste of oxygen is compensated for to some extent by the flushing out of the user's lungs and of the interior of the apparatus that results.

The second time that the user inhales, the outer end of the latch 63 is depressed under the second upper stop 68, freeing the baseplate 59 to rotate under the action of the spring 69. The baseplate may have rotated through 20° so far, and may now rotate through another 20°. The further motion of the baseplate swings the pivot 74 far enough that the distal end of the probe 73 engages the flexible catch 35 and pushes it clear of the lip 37 on the bottom end-cap 17. The bottom end-cap 17 then falls away from the housing 16 under the action of the plastics strap 20, and releases the breathing bag 13 which hangs free from the bottom of the housing 16 under its own weight.

At the same time, the crossbar 61*a*, which remains perpendicular to the first lever 61 and thus rotates with the baseplate 59, engages the cam ramps 58 on the underside of the plastics plate 55. The cam ramps 58 ride up on the ends of the crossbar 61*a*, lifting the plate 55 until the peripheral bead 56 is pressing upwards on the rubber flap 52, holding it tight against the underside of the brass dish 49 and sealing the apertures 51.

At any convenient moment after the apparatus has been removed from the bottom half 26 of the case 25, the user may secure it to his body by straps (not shown) that are fixed to the body and were stored in available spaces between the apparatus and the inside of the case.

The apparatus is thereafter used in manner known per se as a closed-circuit breathing apparatus.

What we claim is:

1. Closed-circuit breathing apparatus comprising a breathing bag; a purifier including purifying material for removing carbon dioxide from a life-supporting gas mixture; said purifier being arranged in operation to be in communication with said breathing bag and with a user; means for supplying oxygen to said apparatus; means for permitting gas to pass from the apparatus to the exterior; said apparatus being arranged when brought into use to operate initially with an open circuit where gas exhaled by a user passes to the exterior and the user inhales gas from said oxygen-supplying means; and means responsive to the breathing of the user to cause said apparatus to change after a predetermined number of inhalations to a closed-circuit operation wherein gas inhaled by the user passes to said breathing bag and the user inhales gas from said breathing bag including gas from said oxygen-supplying means.

2. Breathing apparatus as claimed in claim 1, which comprises a demand valve for supplying oxygen to a user and a common pressure-responsive means which, in operation, both operates the demand valve and causes the change to closed-circuit operation, and which preferably comprises a diaphragm that in use is exposed on one face to ambient pressure and on the other to a gas pressure within the breathing apparatus.

3. Breathing apparatus as claimed in claim 1, which comprises a member movably mounted and resiliently urged to move, a latch reciprocable between first and second positions, a plurality of stops arranged to be engaged by the latch at successive positions of the movably mounted member and thereby to prevent further movement of that member under the resilient urging, the latch being free to pass alternate ones of the said stops at its first and second positions respectively and having no position at which it is free to pass two successive stops, wherein in operation the means responsive to the breathing of a user causes the latch to reciprocate and to engage and pass each said stop in turn, and wherein after the latch passes the last stop the movably mounted member is free to move to cause or permit the apparatus to change to closed circuit operation.

4. Breathing apparatus as claimed in claim 3, wherein the movably mounted member is rotatably mounted, preferably in a plane that lies parallel to a diaphragm that is arranged to reciprocate the reciprocable latch, and preferably sweeps out as it rotates a region of the said plane that lies substantially face-to-face with the diaphragm, and the reciprocable latch is mounted on a radially outer portion of the movably mounted member, and the stops are on an adjacent fixed member of the apparatus.

5. Breathing apparatus as claimed in claim 1, which is arranged to change to closed-circuit operation when the user inhales from it for the second time.

6. Breathing apparatus as claimed in claim 1, which comprises a non-return valve for permitting gas exhaled by the user to escape from the apparatus in open-circuit operation and means for holding the non-return valve closed in closed-circuit operation, wherein the non-return valve is preferably constituted by a diaphragm having one or more apertures therethrough and a flap attached to the diaphragm and overlying the aperture or apertures, a closure member is then arranged to hold the flap against the diaphragm to hold the non-return valve closed, and an actuator is then arranged to act between the diaphragm and the closure member.

7. Breathing apparatus as claimed in claim 1, wherein said means responsive to a breathing of the user comprises a diaphragm having one or more apertures therethrough, wherein a flap attached to the diaphragm and overlying the aperture or apertures constitutes a non-return valve for permitting gas exhaled by the user to escape from the apparatus in open-circuit operation, a closure member is arranged to hold the flap against the diaphragm to hold the non-return valve closed in closed-circuit operation, and an actuator is arranged to act between the diaphragm and the closure member to actuate the closure member.

8. Breathing apparatus as claimed in claim 7, wherein the said actuator is rotatable with the said rotatably-mounted member and is arranged to act by its rotation to urge the closure member against the flap, and wherein the diaphragm and the closure member are preferably non-rotatably mounted, the actuator is then secured against axial movement relative to the diaphragm and so arranged that rotation of the actuator over a pre-determined part of its travel causes axial movement of the closure member by the engagement of cam means.

9. Breathing apparatus as claimed in claim 1, wherein in a ready-for-use condition of the apparatus said breathing bag is stored in a collapsed condition, and which comprises means for releasing the breathing bag when the apparatus changes to closed-circuit operation.

10. Breathing apparatus as claimed in claim 9, wherein a housing portion of the apparatus has a pair of detachable end-caps, within one of which is stored the breathing bag and within the other of which is stored a mouthpiece or the like, wherein when the apparatus is brought into use both end-caps are released from a common fastening, and the said one endcap, over the breathing bag, is then held by a catch until the apparatus changes to closed-circuit operation.

11. Breathing apparatus as claimed in claim 10, which comprises a probe that is retained within the said one end-cap when that end-cap is closed but is free of the said one end-cap when that end-cap is held by the said catch, and which probe is arranged to release the catch when the apparatus changes to closed-circuit operation, and thereby to release the breathing bag, and wherein the retention of the probe within the said one end-cap preferably retains in an initial position a mechanism for effecting the change to closed-circuit operation.

12. Breathing apparatus as claimed in claim 1, wherein said oxygen-supplying means comprises a reservoir for oxygen under a pressure higher than ambient pressure.

13. Breathing apparatus arranged when brought into use to operate initially with an open circuit, wherein a user inhales from a gas source independent of the breathing apparatus and exhales to the atmosphere, and then to change automatically to closed-circuit operation, wherein a user exhales into and inhales from the breathing apparatus, said breathing apparatus comprising:

means responsive to the breathing of a user to cause the change to closed-circuit operation;

a member movably mounted and resiliently urged to move, a latch reciprocable between first and second positions, a plurality of stops arranged to be engaged by the latch at successive positions of the movably mounted member and thereby to prevent further movement of that member under the resilient urging, the latch being free to pass alternate ones of said stops at its first and second positions respectively and having no position at which it is free to pass two successive stops;

wherein in operation the means responsive to the breathing of a user causes the latch to reciprocate and to engage and pass each said stop in turn, and wherein after the latch passes the last stop the movably mounted member is free to move to permit the apparatus to change to closed-circuit operation.

14. Breathing apparatus as claimed in claim 13, wherein the movably mounted member is rotatably mounted, preferably in a plane that lies parallel to a diaphragm that is arranged to reciprocate the reciprocable latch, and preferably sweeps out as it rotates a region of the said plane that lies substantially face-to-face with the diaphragm, and the reciprocable latch is mounted on a radially outer portion of the movably mounted member, and the stops are on an adjacent fixed member of the apparatus.

15. Breathing apparatus arranged when brought into use to operate initially with an open circuit, wherein a user inhales from a gas source independent from said breathing apparatus and exhales to the atmosphere, and then to change automatically to closed-circuit operation, wherein a user exhales into and inhales from the breathing apparatus, said breathing apparatus including means responsive to the breathing of a user to cause the change to closed-circuit operation, and said apparatus being constructed and arranged to change to closed-circuit operation when the user inhales from it for the second time.

16. Breathing apparatus arranged when brought into use to operate initially with an open circuit, wherein a user inhales from a gas source independent of the breathing apparatus and exhales to the atmosphere, and then to change automatically to closed-circuit operation, wherein a user exhales into and inhales from the breathing apparatus, said breathing apparatus comprising:

a non-return valve for permitting gas exhaled by the user to escape from the apparatus in open-circuit operation and means for holding the non-return valve closed in closed-circuit operation, wherein the non-return valve includes a diaphragm and at least one aperture defined in and extending through said diaphragm, and a flap attached to the diaphragm and overlying said aperture, a closure member is then arranged to hold the flap against the diaphragm to hold the non-return valve closed, and an actuator is then arranged to act between the diaphragm and the closure member.

17. Breathing apparatus arranged when brought into use to operate initially with an open circuit, wherein a user inhales from a gas source independent of the breathing apparatus and exhales to the atmosphere, and then to change automatically to closed-circuit operation, wherein a user exhales into and inhales from the breathing apparatus, said breathing apparatus comprising:

means responsive to the breathing of a user to cause the change to closed-circuit operation, said means responsive to the breathing of a user including a diaphragm, at least one aperture defined in and extending through said diaphragm, wherein a flap attached to the diaphragm and overlying the aperture constitutes a non-return valve for permitting gas exhaled by the user to escape from the apparatus in open-circuit operation, a closure member is arranged to hold the flap against the diaphragm to hold the non-return valve closed in closed-circuit operation, and an actuator is arranged to act between the diaphragm and the closure member to actuate the closure member.

18. Breathing apparatus as claimed in claim 17, wherein said actuator is rotatable with said rotatably-mounted member and is arranged to act by its rotation to urge the closure member against the flap, and wherein the diaphragm and the closure member are preferably non-rotatably mounted, the actuator is then secured against axial movement relative to the diaphragm and so arranged that rotation of the actuator over a pre-determined part of its travel causes axial movement of the closure member by the engagement of cam means.

19. Breathing apparatus arranged when brought into use to operate initially with an open circuit, wherein a user inhales from a gas source independent of the breathing apparatus and exhales to the atmosphere, and then to change automatically to closed-circuit operation, wherein a user exhales into and inhales from the breathing apparatus, said breathing apparatus comprising:

a breathing bag stored in a collapsed condition; and means for releasing the breathing bag when the apparatus changes to closed-circuit operation, wherein a housing portion of the apparatus has a pair of detachable end-caps, within one of which is stored the breathing bag and within the other of which is stored a mouthpiece, wherein when the apparatus is brought into use both end-caps are released from a common fastening, and said one end-cap, over the breathing bag, is then held by a catch until the apparatus changes to closed-circuit operation.

20. Breathing apparatus according to claim 19, further comprising:

a probe that is retained within said one end-cap when said one end-cap is closed but is free of said one end-cap said one end-cap is held by said catch, and which probe is arranged to release the catch when the apparatus changes to closed-circuit operation, and thereby to release the breathing bag, and wherein the retention of the probe within said one end-cap preferably retains in an initial position a mechanism for effecting the change to closed-circuit operation.

* * * * *